US005685323A

United States Patent [19]

Crooks et al.

[11] Patent Number: 5,685,323

[45] Date of Patent: Nov. 11, 1997

[54] DISPOSABLE FILTER ATTACHMENT FOR SMOKING ARTICLES

[75] Inventors: Evon Llewellyn Crooks; Barry Smith Fagg; Annette Snow Ludolf, all of Winston-Salem; Dennis Lee Potter, Kernersville, all of N.C.

[73] Assignee: R. J. Reynolds Tobacco Company, Winston-Salem, N.C.

[21] Appl. No.: 506,274

[22] Filed: Jul. 24, 1995

[51] Int. Cl.[6] ..... A24D 3/06

[52] U.S. Cl. ..... 131/331; 131/334

[58] Field of Search ..... 131/342, 344, 131/361, 362, 331

[56] References Cited

U.S. PATENT DOCUMENTS 2,669,995 2/1954 Troy .

3,217,715 11/1965 Berger et al. ..... 131/331

5,074,320 12/1991 Jones, Jr. et al. ..... 131/331

5,360,023 11/1994 Blakley et al. ..... 131/331

5,396,909 3/1995 Gentry et al. .

FOREIGN PATENT DOCUMENTS 1547656 10/1967 France ..... 131/331

*Primary Examiner*—Vincent Millin

*Assistant Examiner*—Charles W. Anderson

[57] ABSTRACT

A disposable filter attachment for smoking articles, such as cigarettes, comprises first and second filter segments and an insertion tube at one end thereof for receiving and supporting a conventional filtered or unfiltered cigarette to be smoked. The first filter segment contains a carbonaceous material for removing gas phase components of the mainstream cigarette smoke. The total pressure drop across the filter attachment is very low, e.g., less than about 15 mm of water at 17.5 cc/sec air flow and preferably in the range of about 3 mm to about 12 mm of water at 17.5 cc/sec air flow.

20 Claims, 1 Drawing Sheet

DISPOSABLE FILTER ATTACHMENT FOR SMOKING ARTICLES

FIELD OF THE INVENTION

The present invention relates to smoking article filters and more particularly to a disposable filter attachment for smoking articles, especially for filtered or unfiltered cigarettes, which incorporates a carbonaceous material capable of removing certain gas phase components of the mainstream smoke from the smoking article.

BACKGROUND OF THE INVENTION

It is well known to incorporate carbon or carbonaceous materials in cigarette filters for the purpose of removing certain gas phase components from the mainstream smoke that passes through the cigarette and filter during draw by the smoker. A significant drawback of many prior art carbon-containing filters is an undesirable change in the organoleptic properties of the smoke. In particular, the mainstream tobacco smoke filtered through many of the prior art carbon-containing filters has a slightly metallic, dry and powdery flavor. U.S. Pat. No. 5,360,023 assigned to the assignee of this invention, the disclosure of which is incorporated herein by reference, describes a cigarette filter that includes a filter segment containing a carbonaceous material which does not suffer the aforementioned undesirable changes in organoleptic properties, at least in part because some of the aerosol particles of the mainstream smoke pass through open channels in the carbon-containing filter.

It is also well known to provide a separate filter element for attachment by the consumer to a smoking article, such as a cigar or cigarette. Such filter elements may include a molded plastic mouthpiece or holder containing a disposable filter element. The filter element may include a carbonaceous material, that may be replaced with a new filter element after each use or after several uses. The mouthpiece is provided with a tubular recess at one end for receiving a conventional cigar or cigarette.

Typically, such prior art filter elements are designed to filter the mainstream smoke from the smoking article and consequently provide additional pressure drop over that provided by the smoking article. In the case of unfiltered cigarettes, such additional pressure drop is readily perceived by the consumer, but usually can be accommodated by the consumer. In the case of filtered cigarettes, this additional filtration may result in an excessive pressure drop that can result in a smoking article that is too hard for the consumer to comfortably draw.

In the case of smoking article holders with replaceable filters, e.g., molded plastic holders, the holder must be periodically cleaned of residue to avoid an unpleasant taste being carried over into the mainstream smoke of the smoking article. The tasks of filter replacement and cleaning the holder are unpleasant as well as time consuming.

Accordingly, it would be desirable to provide a low-cost disposable filter for attachment to and use with conventional smoking articles, such as cigarettes, which incorporates a carbonaceous material which has a minimal effect on the pressure drop of the smoking article to which it is attached, and minimal organoleptic changes.

SUMMARY OF THE INVENTION

The present invention is directed to a disposable filter attachment for smoking articles, especially cigarettes, which removes certain gas phase components from the mainstream smoke by incorporation of a carbonaceous material in the filter element. The filter attachment also has a minimal effect on the pressure drop of a smoking article to which it is attached. The filter attachment preferably comprises a two segment filter, namely, a mouth end segment and an insertion end segment. The two filter segments are combined together with a combiners wrap which forms a cylindrical tubular recess adjacent the insertion end segment for receiving a conventional filtered or unfiltered cigarette or other smoking article.

Preferably, the carbonaceous material is provided in the insertion end of the filter attachment in a filter segment comprising a gathered web of carbon-containing paper of the type disclosed in the aforesaid U.S. Pat. No. 5,360,023. The gathering of the web results in the formation of open channels or voids extending longitudinally through the segment and having varying cross-sectional shapes and areas. The number of channels may also vary and the paper may be corrugated or embossed to increase the number of channels over that provided by gathering a flat paper sheet. The cross-sectional void area of the channels of the insertion end segment, i.e., the area of the channels when the segment is viewed from one end is greater than about 5 percent of the total cross-sectional area, and typically ranges from about 5 percent to about 65 percent of the total cross-sectional area, generally from about 8 percent to about 50 percent and frequently greater than about 30 percent of the total cross-sectional area.

The pressure drop across the carbon-containing filter segment is preferably quite low. For a filter rod segment having a circumference of about 23 mm to about 27 mm, the pressure drop is typically less than about 2 mm of water at 17.5 cc/sec air flow per 1 mm length of the filter segment, usually less than about 1.0 mm, preferably in the range of about 0.2 mm to about 0.3 mm and most preferably less than about 0.2 mm of water at 17.5 cc/sec air flow per 1 mm length of the filter segment. Pressure drops specified herein are as measured using a Filtrona Filter Test Station (CTS Series) available from Filtrona Instruments and Automation Ltd.

The mouth end segment of the filter attachment preferably has the appearance and feel of the mouth end of a conventional cigarette filter, e.g., a cellulose acetate filter. In one embodiment of the invention, the mouth end segment is a gathered polymeric film of the type disclosed in U.S. Pat. No. 5,396,909, assigned to the assignee of the present invention and the disclosure of which is incorporated herein by reference. Such a film is preferably imperforate and is loosely gathered so as to provide a low pressure drop longitudinally through the segment. For a filter segment formed of a gathered polymeric film and having a circumference of about 23 mm to about 27 mm, the pressure drop is typically less than about 2 mm of water at 17.5 cc/sec air flow per 1 mm length of the filter segment, usually less than about 1.0 mm, preferably in the range of about 0.1 mm to about 0.4 mm and most preferably less than about 0.2 mm water at 17.5 cc/sec air flow per 1 mm length of the filter segment.

One additional advantage of using the gathered polymeric film described above apart from its low pressure drop is that a whitener may be included in the polymeric film so that the mouth end of the filter has a white or off-white appearance comparable to the appearance of a conventional cellulose acetate filter. Even after smoking, the mouth end still has a relatively white or off-white appearance with little or no staining as explained in the aforesaid U.S. Pat. No. 5,396,909.

In another embodiment of the invention, the mouth end segment is a very low efficiency cellulose acetate filter segment, preferably with a pressure drop comparable to the pressure drop of the first embodiment of the mouth end segment with a gathered polymeric film. A pressure drop of about 1.0 mm to about 1.5 mm of water at 17.5 cc/sec air flow per 1 mm length of the filter element is typical of the lowest efficiency cellulose acetate tow available, e.g., 6.0 denier per filament/36000 total denier. Those skilled in the art will appreciate that lower efficiency cellulose acetate tows may be manufactured.

The carbon-containing insertion end segment may be made by gathering a five to twelve inch wide carbon paper containing 50% carbon and 50% unbleached wood pulp into a 72 mm long rod about 25 mm in circumference using, for example, a KDF filter maker manufactured by Korber AG of Hamburg, Germany. The gathered polymeric film for the mouth end segment may be made by gathering a 4.5 to 7.0-inch, and preferably a 5.5-inch wide polyethylene web, also using a KDF filter maker, into a 72 mm rod about 25 mm in circumference.

The 72 mm carbon-containing rod is combined with a 72 mm rod of either the gathered polymeric film or the cellulose acetate tow on a Mullins combher machine in a configuration of 4-up filter rods. Combined rods of 112 mm length are cut into four individual disposable filters 28 mm in length, each comprising a 12 mm carbon-containing insertion end segment, a 6 mm gathered polymeric film or cellulose acetate mouth end segment and a 10 mm hollow insertion tube at the insertion end of the disposable filter.

A conventional filtered or unfiltered cigarette may be inserted into the void space of suitable length (e.g.,10 mm) hollow insertion tube of the disposable filter of the invention and smoked. The carbon-containing filter segment substantially reduces gas phase components of the mainstream smoke as explained in the aforesaid U.S. Pat. No. 5,360,023. The total pressure drop of the disposable filter is preferably as low as possible so as to minimize any additional pressure drop of the combination of the conventional cigarette and the disposable filter of the invention. A total pressure drop of zero would, of course, be desirable, but it has been found that pressure drops for the disposable filter of the invention less than about 12 mm, i.e., in the range of about 3 mm to about 12 mm water at 17.5 cc/sec air flow provide an acceptably low pressure drop for the disposable filter of the invention. Filter segment combinations having higher total pressure drops, i.e., in the range from about 12 mm to about 100 mm water at 17.5 cc/sec air flow, may be used, especially for an unfiltered cigarette or filtered cigarette from which the filter has been removed for use with the disposable filter of the present invention.

After a conventional filtered or unfiltered cigarette is inserted into the hollow insertion tube at the insertion end of the disposable filter attachment of the invention, it may be lighted and smoked in the usual manner. The carbon-containing filter segment reduces the gas phase components of the mainstream smoke of the conventional cigarette without the undesirable dry metallic taste typical of some carbon-containing filters. After smoking, the spent cigarette with its conventional filter (if a filtered cigarette) and the filter attachment of the present invention may be discarded together without separating the spent cigarette from the filter attachment in the same way disposal of conventional cigarettes is carried out.

With the foregoing and other advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
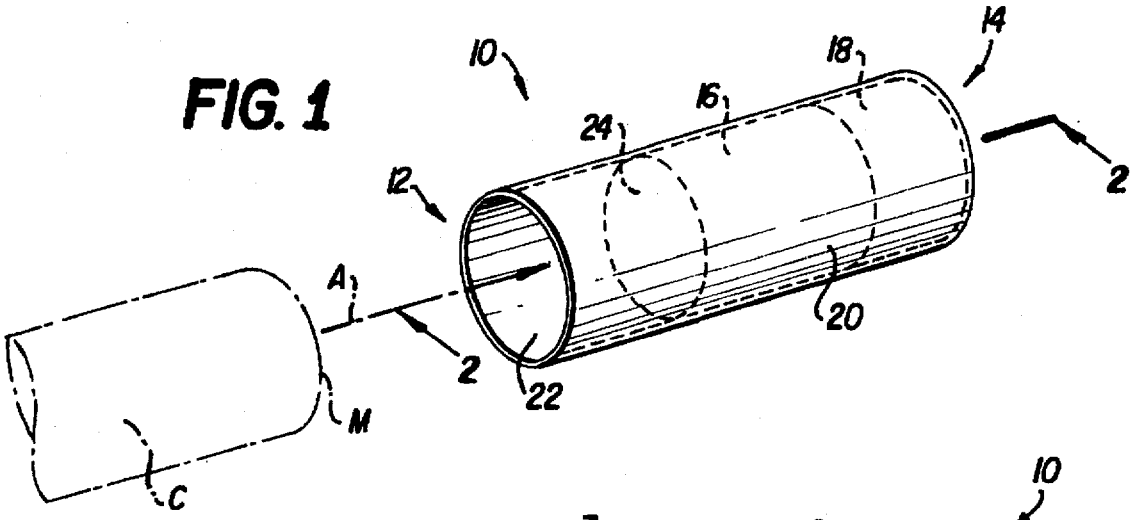
FIG. 1 is a perspective view of the disposable filter attachment of the present invention shown with a conventional cigarette ready for insertion into the filter attachment.

Referring now in detail to the drawings, there is illustrated in FIG. 1, a disposable filter attachment for a smoking article, such as a cigarette C, which is designated generally by reference numeral 10. Filter attachment 10 has an insertion end 12 and a mouth end 14 and is a dual segment filter comprising a first or insertion end filter segment 16 and a second or mouth end filter segment 18 which are combined together in with an abutting combher wrap 20.

Combiner wrap 20 is a stiff paper similar to a tipping paper for cigarettes and overlaps the end of the first filter segment 16 at the insertion end 12 of filter attachment 10 by about 8–12 mm, preferably about 10 mm to form a hollow insertion tube 22 at the insertion end 12 of the attachment 10. The insertion tube 22 has an inside diameter of a sufficient size to receive the mouth end of a filtered or unfiltered cigarette C along the longitudinal axis A thereof so that the mouth end M of the cigarette C abuts the confronting face 24 of the first filter segment 16. Mainstream smoke from cigarette C may thus be drawn by the smoker through the first and second filter segments 16, 18 to the mouth end 14 of the filter attachment 10.

The exterior surface of the combiner wrap 20 may be printed in a conventional manner so as to give the appearance of a cork tipping paper or any other suitable appearance. The cigarette C, as previously mentioned, may be a filtered or unfiltered cigarette, or a filtered cigarette from which the filter has been removed. If the cigarette is a filtered cigarette, it may be air diluted by circumferential dilution holes (not shown) in the filter of cigarette C. Typically, dilution holes in conventional filtered cigarettes are located greater than about 12–15 mm away from the mouth end of the filter so that the insertion tube 22 will not block ventilating air flow through the dilution holes of the cigarette C.

Figure 2:
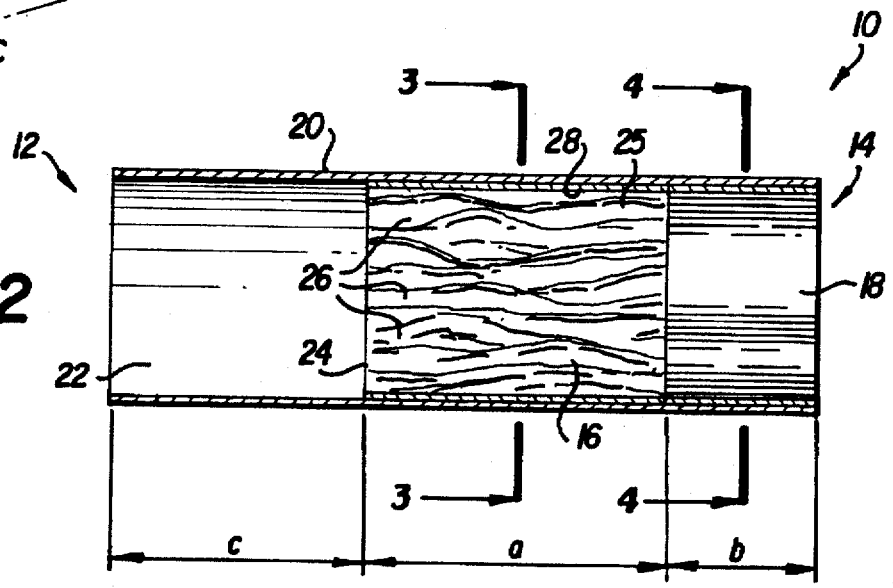
FIG. 2 is a longitudinal cross-sectional view of the disposable filter attachment of the present invention taken along line 2—2 of FIG. 1.
Figure 3:
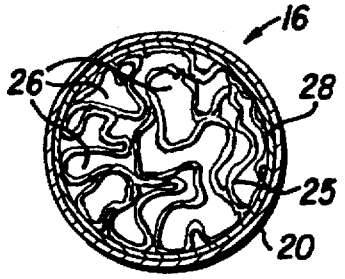
FIG. 3 is a transverse cross-sectional view of the carbon-containing filter segment of the filter attachment of the invention taken along line 3—3 of FIG. 2.

Referring now to FIGS. 2 and 3, the first filter segment 16 has a length a and comprises a carbon-containing paper 25 which has been gathered to form a plurality of open channels 26 through the filter segment from end-to-end. The paper 25 may be, for example, KCG 50 made by Kimberly-Clark Corporation and containing 50% carbon and 50% wood pulp by weight. The filter segment 16 is wrapped with a paper plug wrap 28. As described above, the first filter segment 16 is made according to U.S. Pat. No. 5,360,023 with a cross-sectional void area greater than about 5 percent of the total cross-sectional area of the filter segment.

Figure 4A:
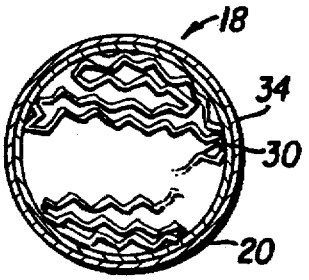
FIG. 4A is a transverse cross-sectional view of a first embodiment of the mouth end filter segment of the filter attachment of the invention taken along line 4—4 of FIG. 2.
Figure 4B:
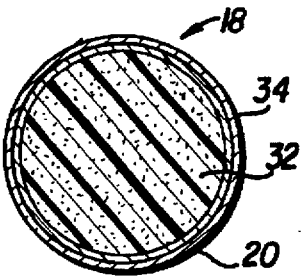
FIG. 4B is a transverse cross-sectional view of a second embodiment of the mouth end filter segment of the filter attachment of the invention taken along line 4—4 of FIG. 2.

The second filter segment 18 has a length b and comprises either a gathered polymeric film 30 (FIG. 4A) which has been whitened to give the white or off-white appearance of a cellulose acetate filter or a low efficiency cellulose acetate filter 32 (FIG. 4B). Second filter segment 18 is wrapped with a paper plug wrap 34. The gathered polymeric film 30 of the second segment 18 may be made according to U.S. Pat. No. 5,396,909 from an imperforate polyethylene film which has been whitened, e.g., with a calcium carbonate filler.

The filter segments 16, 18 are combined with combher wrap 20 in a 4-up filter rod configuration of 112 mm length as described above. When the 4-up filter rod is cut into individual filters a hollow tubular end having a length c is formed. Although the lengths a, b and c may vary, acceptable filter attachments have been made which are 28 mm in length and comprise a 10 mm insertion tube 22, a 12 mm first filter segment 16 and a 6 mm second filter segment 18.

It will be understood that the above dimensions of the lengths a, b and c may vary so long as the function of each portion is retained. For example, it would be possible to increase or decrease the length of the insertion tube 22 so long as the cigarette C can be inserted and supported in the tube without blocking any air dilution holes in the filter of the cigarette and without the cigarette C falling out of the tube. The length of the carbon-containing first filter segment 16 may also be increased or decreased so long as it effectively performs the function of removing gas phase components of the mainstream smoke. Similarly, the second filter segment 18 may be increased or decreased in length so long as it provides the appropriate appearance to the mouth end and does not significantly increase the pressure drop thereacross.

The overall pressure drop across the filter attachment 10 is as low as possible, preferably zero pressure drop, so that the smoker does not perceive any increase in pressure drop of the cigarette C. From a practical standpoint, it is not possible to achieve a zero pressure drop so that the pressure drop is typically in the range of about 3 mm to about 12 mm water at 17.5 cc/sec air flow. Greater pressure drops, e.g., about 12 mm to about 100 mm, may be used, but are not preferred because additional pressure drop above about 100 mm water over the normal pressure drop of the cigarette C is likely to be adversely perceived by the smoker.

The following examples are provided in order to further illustrate the invention but should not be construed as limiting the scope thereof. Pressure drops are given in mm of water at 17.5 cc/sec air flow. Filter attachments substantially as shown in FIGS. 1 and 2 are provided as follows:

EXAMPLE 1

| | |
|---|---|
| Carbon-containing Segment | |
| Carbon Paper | KCG 50 |
| Paper Width | 5.0 inches gathered web |
| Pressure Drop of 72 mm rod | 15.6 mm |
| Plug Wrap | Glatz FA3B-28 (nonporous) |
| Segment Length | 12 mm |
| Segment Circumference | 24.98 mm |
| Segment Pressure Drop | 2.6 mm |
| Mouth End Segment | |
| Gathered Web | Polyethylene (97% HD 3% LD) |
| Pressure Drop of 72 mm rod | 10 mm |
| Plug Wrap | Glatz FA3B-28 (nonporous) |
| Segment Length | 6 mm |
| Segment Circumference | 24.98 mm |
| Segment Pressure Drop | >1.0 mm |

-continued

EXAMPLE 2

| | |
|---|---|
| Carbon-containing Segment | |
| Carbon Paper | KCG 50 |
| Paper Width | 6.0 inches gathered web |
| Pressure Drop of 72 mm rod | 33.4 mm |
| Plug Wrap | Glatz FA3B-28 (nonporous) |
| Segment Length | 12 mm |
| Segment Circumference | 24.98 mm |
| Segment Pressure Drop | 5.6 mm |
| Mouth End Segment | |
| Gathered Web | Polyethylene (97% HD 3% LD) |
| Pressure Drop of 72 mm rod | 10 mm |
| Plug Wrap | Glatz FA3B-28 (nonporous) |
| Segment Length | 6 mm |
| Segment Circumference | 24.98 mm |
| Segment Pressure Drop | >1.0 mm |

EXAMPLE 3

| | |
|---|---|
| Carbon-containing Segment | |
| Carbon Paper | KCG 50 |
| Paper Width | 6.0 inches gathered web |
| Pressure Drop of 72 mm rod | 22.6 mm |
| Plug Wrap | Glatz FA3B-28 (nonporous) |
| Segment Length | 12 mm |
| Segment Circumference | 24.98 mm |
| Segment Pressure Drop | 3.7 mm |
| Mouth End Segment | |
| Filter Tow | Cellulose Acetate |
| DPF/Total Denier | 6.0 Y/3600 Rhodia |
| Plasticizer | 9.0% Triacetin |
| Pressure Drop of 72 mm rod | 101 mm |
| Plug Wrap | Glatz FA3B-28 (nonporous) |
| Segment Length | 6 mm |
| Segment Circumference | 24.98 mm |
| Segment Pressure Drop | 8.4 mm |

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A disposable filter for attachment to a smoking article, such as a cigarette, by a user, comprising a filter element having a mouth end and an insertion end and a cross-sectional area, said filter element comprising first and second separately formed filter segments positioned in longitudinal abutting relation with the second filter segment at the mouth end of the filter element, said first filter segment comprising a gathered web of a paper containing a carbonaceous material, the paper being gathered so as to form a plurality of longitudinal channels each having a longitudinal axis, each channel being open from end to end of said first filter segment along the longitudinal axis thereof, each channel further having a cross-sectional void area, the total cross-sectional void area of said open channels comprising more than about 5 percent of the cross-section area of the first filter segment such that at least some mainstream smoke from a smoking article attached to the insertion end of the filter element passes through the open channels of the first filter segment, the cross-sectional area of the first filter segment being entirely filled with the carbonaceous paper and said open channels, a hollow insertion tube formed longitudinally adjacent the first filter segment at the insertion end of the filter element for axial insertion of a smoking article by the user, said insertion tube having an axial length and a diameter sufficient to receive and support a smoking article therein, the total pressure drop across said two segments being sufficiently low as to have a minimal effect on the pressure drop of the smoking article to which the disposable filter is attached.

2. The filter of claim 1, wherein the total pressure drop across said two filter segments is less than about 15 mm of water at 17.5 cc/sec air flow.

3. The filter of claim 1, wherein the total pressure drop across said two filter segments is less than about 12 mm of water at 17.5 cc/sec air flow.

4. The filter of claim 1, wherein the total pressure drop across said two filter segments is in the range of about 3 mm to about 12 mm of water at 17.5 cc/sec air flow.

5. The filter of claim 1, wherein the second filter segment comprises a gathered polymeric film.

6. The filter of claim 5, wherein said polymeric film is a polyethylene film containing a whitener.

7. The filter of claim 1, wherein the second filter segment comprises a low efficiency cellulose acetate tow.

8. The filter of claim 7, wherein the pressure drop across the second filter segment is less than about 12 mm of water at 17.5 cc/sec air flow.

9. The filter of claim 7, wherein said cellulose acetate tow is a 6.0 dpf/36000 tow.

10. The filter of claim 1, including a combiner wrap circumscribing the first and second filter segments, said combiner wrap extending axially past the first filter segment to form said hollow insertion tube.

11. The filter of claim 10, wherein said first filter segment has a length of about 12 mm, said second filter segment has a length of about 6 mm and said insertion tube has a length of about 10 mm.

12. The filter of claim 1, wherein said gathered paper web comprises about 50 percent by weight carbon and about 50 percent by weight wood pulp.

13. The filter of claim 1, wherein the smoking article supported in said insertion tube is a filtered cigarette having a second filter element, the second filter element being inserted into the insertion tube of the disposable filter and supported thereby such that the mainstream smoke from said filtered cigarette passes through the second filter element and through the disposable filter attached to said filtered cigarette.

14. A disposable filter for attachment to a cigarette by a user comprising finest and second separately formed filter segments positioned in longitudinal abutting relation, said first filter segment comprising a carbonaceous material for contacting the mainstream smoke from the cigarette attached thereto, a combiner wrap circumscribing the first and second filter segments and forming a hollow insertion tube longitudinally adjacent the first filter segment, said hollow insertion tube having an axial length and a diameter sufficient to receive and support said cigarette for smoking, the total pressure drop across said first and second segments being less than about 12 mm of water at 17.5 cc/sec air flow.

15. The disposable filter of claim 14, wherein the total pressure drop across said two filter segments is in the range of about 3 mm to about 12 mm of water at 17.5 cc/sec air flow.

16. The disposable filter of claim 14, wherein said first filter segment comprises a gathered web of a paper containing said carbonaceous material, the paper being gathered so as to form a plurality of longitudinal channels each having a longitudinal axis, each channel being open from end to end of said first filter segment along the longitudinal axis thereof, each channel further having a cross-sectional void area, the total cross-sectional void area of said open channels comprising more than about 5 percent of the cross-sectional area of the first filter segment such that at least some mainstream smoke from said cigarette supported in said insertion tube passes through the open channels of the first filter segment, the cross-sectional area of the first filter segment being entirely filled with the carbonaceous paper and said open channels.

17. The disposable filter of claim 14, wherein the second filter segment comprises a gathered polymeric film.

18. The disposable filter of claim 14, wherein said polymeric film is a polyethylene film containing a whitener.

19. The disposable filter of claim 14, wherein the second filter segment comprises a low efficiency cellulose acetate tow.

20. The disposable filter of claim 14, wherein said first filter segment has a length of about 12 mm, said second filter segment having a length of about 6 mm and said insertion tube having a length of about 10 mm.

* * * * *